United States Patent [19]

Miyagawa

[11] 4,309,455

[45] Jan. 5, 1982

[54] METHOD FOR MAKING SLEEVES FOR ROTARY SCREEN PRINTING

[75] Inventor: Takeo Miyagawa, Matsudoshi, Japan

[73] Assignee: Kabushiki Kaisha Kenseido, Tokyo, Japan

[21] Appl. No.: 35,239

[22] Filed: May 2, 1979

[30] Foreign Application Priority Data

May 4, 1978 [JP] Japan ..... 53-52804

[51] Int. Cl.[3] ..... B41N 1/24

[52] U.S. Cl. ..... 204/17; 101/128.21; 101/128.4; 427/230; 427/239; 427/304; 427/305; 427/306; 427/143

[58] Field of Search ..... 427/143, 230, 304-306, 427/239; 101/112, 128.2, 128.3, 128.4

[56] References Cited

U.S. PATENT DOCUMENTS

| | | | |
|---|---|---|---|
| 2,255,440 | 9/1941 | Sherman | 101/128.4 |
| 3,482,300 | 12/1969 | Reinke | 101/128.4 |
| 3,610,143 | 10/1971 | Greenwood et al. | 101/128.4 |
| 3,759,800 | 9/1973 | Reinke | 101/128.4 |
| 3,783,779 | 1/1974 | Greenwood et al. | 101/128.2 |

FOREIGN PATENT DOCUMENTS

| | | | |
|---|---|---|---|
| 145591 | 7/1961 | U.S.S.R. | 427/143 |

*Primary Examiner*—Michael R. Lusignan
*Assistant Examiner*—Janyce A. Bell
*Attorney, Agent, or Firm*—Armstrong, Nikaido, Marmelstein & Kubovcik

[57] ABSTRACT

Sharp, endless sleeves for rotary screen printing having superior durability to printing can be obtained by a method of the present invention. According to this method, a metal image-forming layer having a smooth endless outside surface and a thickness in the range of 5-50μ is made, and into the inside thereof is inserted a cylindrical screen sleeve as an image-supporter made of a metal or a non-metallic material having been processed to provide electric conductivity thereto, and both the layers and the sleeve are fixed to each other with electro- or chemical- plating, or on the outside of a cylindrical screen sleeve, is formed a smooth surface of endless image-forming layer by plating while partly coating the screen-sleeve.

8 Claims, 20 Drawing Figures

METHOD FOR MAKING SLEEVES FOR ROTARY SCREEN PRINTING

BRIEF SUMMARY OF THE INVENTION

Field of the Invention

The present invention relates to a method for producing sleeves for rotary screen printing in which cylindrical screens including metal screens or nonmetallic screens coated with metals (which will be hereinafter referred to as sleeves) as an image-supporter are formed in the inside of thin membranes of metal cylinders, as an endless or seemless image-forming layer, by way of a plating process including a chemical plating and electroplating.

More specifically, the present invention relates to a method for producing sleeves for rotary screen printing in which thin membranes of metal cylinders having a thickness in the range of 5–50$\mu$, as an image-forming layer are made in the inside of metal cylinders, as a master roll, by way of plating; sleeves as an image-supporter are made by way of plating by using a separate master roll, or by weaving filaments of a metal or a non-conductive material (including yarns of synthetic fibers and artificial fibers) and forming them into cylindrical forms and fixing the resulting mesh of the net by way of plating so as to prevent shifting thereof (these sleeves will be referred to as sleeves of metal filaments or the like); these sleeves of metal filaments or the like are inserted in the inside of thin membranes of metal cylinders as the image-forming layer, both are fixed by way of a plating process, or sleeves are inserted in the inside of metal cylinders, and smooth image-forming layers are formed on the outside of the sleeves i.e. in the inside of metal cylinders while partly coating the sleeves by way of plating.

The sleeves for rotary screen printing made according to the process of the present invention as well as according to conventional processes will be described by referring to the accompanying drawings hereinafter described.

Figure 4A:
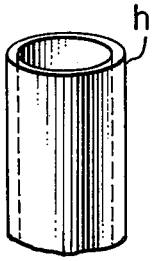

FIG. 4*a* is a perspective view of a metal cylinder employed in the method of the present invention.

Figure 4B:
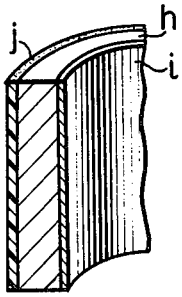

FIG. 4*b* is a cross-sectional view of a metal cylinder containing a plated releasing layer, a metal cylinder layer and a non-conductive resin layer, employed in the present invention.

Figure 4C:
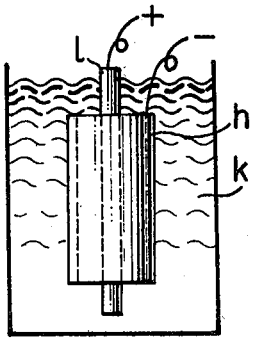

FIG. 4*c* is a schematic view of the cross-section of an electric cell wherein an image-forming layer is made by plating according to the method of the present invention.

Figure 4D:
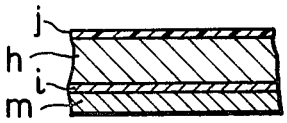

FIG. 4*d* is a cross-sectional view of an image-forming layer made in the inside of a metal cylinder according to the method of the present invention.

Figure 5A:
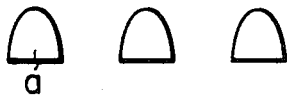
FIG. 5a PRIOR ART

FIG. 5*a* is a schematic cross-sectional view of a screen made according to a plating method.

Figure 5B:
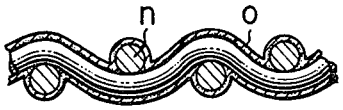
FIG. 5b PRIOR ART

FIG. 5*b* is a schematic cross-sectional view of a screen where woven metal filaments or synthetic fiber yarns are set by plating.

Figure 6:
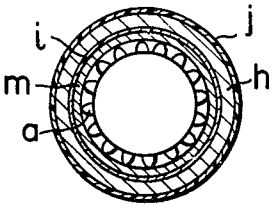

FIG. 6 is a schematic cross-sectional view illustrating the state where a sleeve as an image-supporter is inserted into the inside of a metal cylinder having an image-forming layer.

Figure 7:
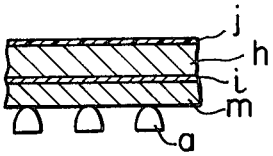

FIG. 7 is an enlarged cross-sectional view of the contact part after the above-mentioned insertion.

Figure 8:
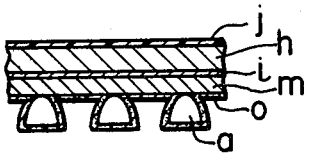

FIG. 8 is a cross-sectional view of the adhesion part between an image-forming layer and a sleeve layer as an image-supporter by means of plating.

Figure 9:
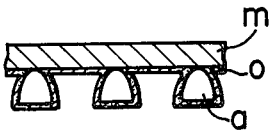

FIG. 9 is a cross-sectional view (of a sleeve and an image-forming layer) where an image-forming layer is released.

Figure 10A:
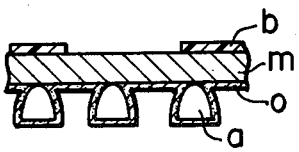

FIG. 10*a* is a cross-sectional view (of a sleeve and an image-forming layer) where a resin layer adhered onto an image-forming layer is exposed to light and developed.

Figure 10B:
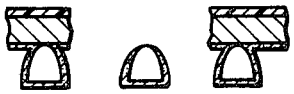

FIG. 10*b* is a cross-sectional view of metal portion (a sleeve and an image-forming layer) which is not coated with resin after exposure to light and subjected to etching.

Figure 11A:
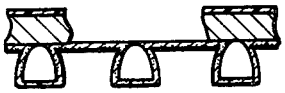

FIG. 11*a* is a cross-sectional view (of a sleeve and an image-forming layer) where only an image-forming layer is etched.

Figure 11B:
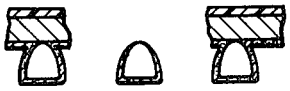

FIG. 11*b* is a cross-sectional view as in FIG. 11*a* where copper alone is etched and nickel is not etched.

Figure 12A:
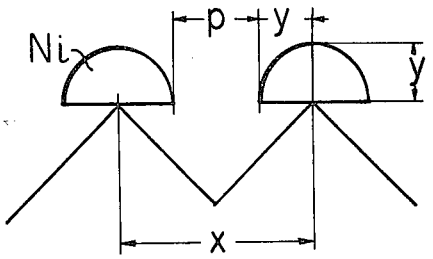
FIG. 12a PRIOR ART

FIG. 12*a* is a cross-sectional view illustrating the dimension of an opening of a screen formed according to lacquer process.

Figure 12B:
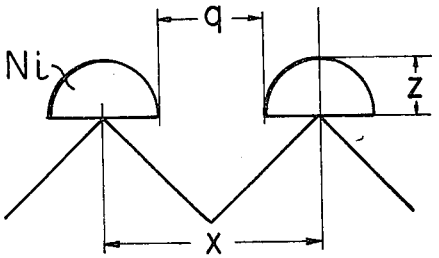
FIG. 12b PRIOR ART

FIG. 12*b* is a cross-sectional view illustrating the dimension of the opening of a screen according to the method of the present invention.

Figure 12C:
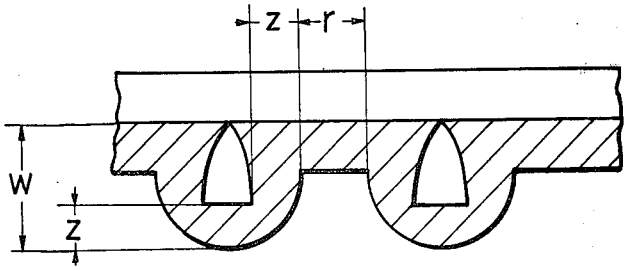

FIG. 12*c* is a cross-sectional view illustrating the dimension of the opening of a screen after etching according to the method of the present invention.

BACKGROUND OF THE INVENTION

At present, sleeves for rotary screen printing (hereinafter referred to as printing sleeves) are made according to a following process:

(1) According to a lacquer process, in which a sleeve is made by way of plating,
   - (i) a surface of a roll of a metal such as iron or the like is plated with copper and the plated surface is polished;
   - (ii) mesh dents or depressions are made on the polished copper surface by using an indentation machine of hardened mill rolls having a higher hardness and an appropriate pattern of protruded mesh which is prepared in advance;
   - (iii) chromium plating is applied onto the copper surface;
   - (iv) a non-conductive resin is embedded in the mesh dents, and the roll obtained through the above-mentioned steps is called a master roll;
   - (v) the master roll is immersed in a nickel plating bath to give a thickness of plating of 70–120$\mu$;
   - (vi) the nickel portion is drawn out from the master roll to provide a sleeve as an image-supporter;
   - (vii) the surface of the sleeve, as an image-supporter is coated with a solution of a light-sensitive resin which is subsequently dried to give an image-forming layer; and then
   - (viii) an image is formed according to a common photomechemical process to give a sleeve for printing.

Figure 1:
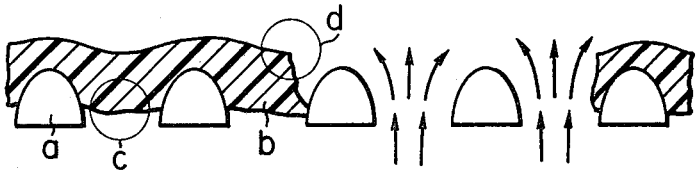
FIG. 1 PRIOR ART
FIG. 1 is a schematic view of the section of an image-forming layer on which an image is formed according to a photo-mechanical process through a conventional lacquer method, and a sleeve as an image-supporter.

A section of the sleeve for printing thus obtained is shown in FIG. 1 wherein a is nickel as an image-supportor and b is a cured layer of a light-sensitive resin as an image-forming layer. In this process, there are the following drawbacks:

(i) Since an image-forming layer is of a resin, it is inferior in resistance to solvent and durability to printing.

(ii) As shown in the c portion of FIG. 1, a light-sensitive resin enters the inside of mesh holes and on this account attainment of uniform thickness of membranes all over the surface and smooth surface is difficult.

(iii) As shown in the d portion of FIG. 1, when the end part of an image is terminated half way of a mesh hole, the resin cured by exposure to light swells at the time of development and blocks the mesh hole even when the light exposure is accurately carried out till the halfway. As a result, the mesh holes become either completely opened or completely closed.

Figure 2:
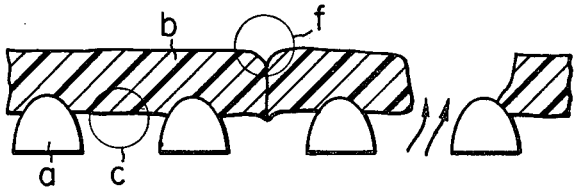
FIG. 2 PRIOR ART
FIG. 2 is a schematic cross-sectional view of an image-forming layer and a sleeve as an image-supporter made by thermally contact-bonding a film-form photosensitive resin for forming an image-forming layer.

(2) There is a process in which a film-form light sensitive resin is adhered under hot pressing in order to improve the drawback of coating with a liquid light-sensitive resin as an image forming layer. However, there is a drawback shown in FIG. 2. Namely, as shown in the c portion of FIG. 2, entering of a resin into the mesh holes of the sleeve becomes less, and the contact area of a resin b whose surface has been smoothed, as in image-forming layer, with a sleeve, becomes smaller as compared with that in case of FIG. 1, resulting in much poorer resistances to solvent and durability to printing. Thus as shown in the f portion of FIG. 2, it is entirely impossible to obtain a completely seamless and endless surface because of joining portions of film of a light-sensitive resin.

In the method of the present invention, all the image-forming layer is made of metal, and fixing thereof with an image-supporter is made by way of a plating process.

(3) In the processes in which an image-forming layer is entirely of metal, there is a process called a galvano process which will be explained as follows:

(i) The surface of a stainless steel roll or an iron roll whose surface is plated with chromium, is coated with a light-sensitive resin which is subsequently dried.

(ii) A film of image containing meshes which has been prepared in advance, is wound round the roll and exposed to light.

(iii) After development and washing with water, plating is carried out in a nickel-plating bath to give a definite thickness.

(iv) The nickel-plated part is drawn out from the roll to give a sleeve for printing.

Figure 3:
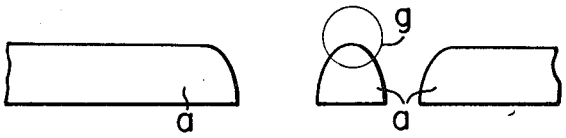
FIG. 3 PRIOR ART
FIG. 3 is a schematic cross-sectional view of a sleeve having an image according to a galvano process.

In this process, since an image-forming layer and an image-supporter are formed in one layer, it is attempted that an image is represented all by points. On this account, as shown in FIG. 3, the top part g of a shoulder or dike of meshes contacts with a to-be-printed material, and such an effect appears that a solid line is forced to be represented by a dotted line, and thus the endless connection of meshes is entirely impossible according to the present level of the art. Thus this process also has drawbacks such as limitation of pattern.

Recently several processes have been announced in which an image-forming layer and a sleeve as an image-supporter, are both made of metal and an image-forming layer is overlaid on an image-supporter. Summary of these processes will be described hereinafter.

(4) As for the steps, after a nickel sleeve as an image-supporter has been made through the same steps as those of the above-mentioned lacquer process, (i) without drawing out the sleeve from a master roll, mesh holes are embedded with an electrically-conductive resin, e.g. a resin mixed with powder of a metal such as copper, followed by drying. In this case, there is a restriction in that the embedded resin must be hard enough to allow polishing operation.

(ii) An excessive resin is adhered because a part of the embedded resin must be adhered to the top surface of shoulders of the screen and all the surface must be uniformly smooth. On this account, after drying, polishing with a relatively fine sand paper such as No. 1000–No. 2000 is carried out. In case of a resin containing a mixed metal powder, the metal surface is exposed but each metal powder is exposed independently, and separated from each other and fixed by a non-electroconductive resin, without showing a continued conductivity over all the surface. Further according to microscopical observation, the boundary of the resin surface and the metal surface of screen is not completely smooth even polished carefully and lightly, forming depressions on the boundary. Also in case where embedding is made with only a non-conductive resin, depressions are likewise formed on the boundary, and the surface of resin does not show complete smoothness as compared with the surface of the metal, but convexes and concaves appear depending upon coarseness of sand paper.

(iii) When a non-conductive resin is embedded, a conductive coating is made by applying chemical plating after polishing.

(iv) Plating is carried out in an electroplating bath to give an image-forming layer having a thickness of 10–30$\mu$. In case of resin containing mixed metal powder, processing of electroplating is generally applied without application of chemical plating, and hence the surface is abundant in convex and concave portions and lacks in smoothness.

(v) Even if an image-forming layer is made of a metal by way of plating and a sleeve as an image-supporter is adhered onto the lower layer thereof, it is impossible to draw it out, as it is, from a master roll, because the embedded resin is firmly adhered to the resin of the master roll. A releasing layer is not prepared because detachment occurs at the time of polishing. For the above-mentioned reason, a pattern which enables to remove an image-forming layer to expose the resin embedded in mesh holes as much as possible is selected, and a metal as an image-forming layer is removed by way of a photographic process using a light-sensitive resin and an eching process to expose the resin embedded in the inside of mesh-holes.

(vi) Then, the exposed resin embedded in the mesh holes is removed by dissolving-out or swelling with a solvent. In many cases, the resin embedded in the master roll is also attacked by a solvent to shorten the duration time of the master roll.

(vii) After the mesh part as an image-supporter (from which the image-forming layer and embedded resin have been removed) is debonded or loosened from a master roll, the embedded resin remaining in the lower part of the metal layer as an image-forming layer is gradually dissolved out with a solvent or detached from the master roll and then drawn out. As a process similar to the above-mentioned process, there is a process disclosed in the specification of Japanese patent publication No. 45327 of 1974.

These methods are extremely complicated and have many drawbacks in steps and qualities such as necessity of a master roll till images are formed, although they have advantages in the point of a metal image-forming layer. Further, as seen in the specification of Japanese utility model publication No. 1841 to 1976, a method is announced in which endless images are formed only by using a plating process simultaneously with a chemical plating process, but the steps thereof are complicated and contain many difficulties such that the thickness of resist must be set to be equal to the thickness of deposited metal.

(5) Further, there is also an announcement of sleeves for rotary screen printing in which after an image-forming layer is used in the form of metal foil prepared through milling, plating or the like, it is spread over a sleeve of image-supporter which has been prepared by weaving with metal filaments or the like or prepared in the form of screen by plating, and the foil and the sleeve are fixed by a plating process or by using an adhesive to form a cylindrical form, the adhesive part being adhered by a patented process (Screen Printing System, Inc. Jeorge W. Reinke). This process is equal to the one in which a plate-form screen disclosed in the Japanese patent publication No. 22897 of 1976 is made into a cylindrical form by using a special technique. However, this process has a drawback of the above-mentioned film-form light-sensitive resin in the point that an image-forming layer cannot be made into an endless form, and many restrictions in the printing pattern are raised.

The above-mentioned are the drawbacks of the conventional methods for producing sleeves but these drawbacks can be completely overcome according to the process of the present invention.

PREFERRED EMBODIMENT OF THE PRESENT INVENTION

The detail of the method of the present invention will be described hereinafter.

The sleeves for rotary screen printing made according to the method of the present invention are constructed with three layers of an image-forming layer, a sleeve layer as an image-supporter and a fixing layer which adheres and fixes the above-mentioned two layers, or two layers which are formed by coating a sleeve layer as an image-supporter made in advance, with a metal by a plating process and at the same time depositing said metal on the outside of said sleeve layer to form an image-forming layer.

(1) In producing an image-forming layer, the inside of a stainless steel or iron cylinder h is cut and polished to give a necessary circumference as shown in FIG. 4*a*.

On the polished surface, chromium plating i is carried out and the outside of the cylinder is coated with a non-conductive resin J. The chromium layer is made to provide hardness, impact resistance and function as a releasing layer. The coating with the non-conductive resin is to avoid deposition of excessive plating metal. The metal cylinder h having the above-mentioned structure is immersed in a nickel plating bath k, e.g. as shown in FIG. 4*c*, and plating is carried out by inserting an anode of nickel l. The thickness m of nickel will be preferably in the range of 5–50$\mu$. Resultant metal layer is used as an image-forming layer m as shown in FIG. 4*d*. The image-forming layer m is not detached from the cylinder constructed with h, i and j, but put into the next step as it is. Thus, an image-forming layer m having an endless and smooth surface can be obtained. As a releasing layer, copper, nickel, etc., can be used. When copper is used, the surface thereof is treated with an aqueous solution of $AgNO_3$ or chromic acid, and when nickel is used, it can be used as it is. As an image-forming layer, beside nickel, e.g. copper can be used as a single or double layer.

(2) In producing a sleeve as an image-supporter, not only a sleeve used for lacquer process but also a sleeve obtained by weaving fine metal filaments such as stainless steel filaments or filaments of chemical synthetic resin e.g. polyester filaments and shaping in the form of seamless cylinder and fixing the woven mesh to prevent its shifting by way of chemical plating in case of chemical synthetic resin or by way of electroplating in case of metal or by simultaneously using both the procedures, can be used. The sectional view of this sleeve is shown in FIG. 5*a* or 5*b*. FIG. 5*a* shows a section of a screen produced by plating procedure and a shows nickel and FIG. 5*b* shows a section of a screen obtained by fixing woven metal filaments or synthetic resin filaments (usually 40–400 mesh) by way of plating wherein n shows metal wire or synthetic resin filaments, and O shows plating metal. The thickness of sleeve is in the range of 40–120$\mu$. After completion of plating or weaving and shaping in the form of seamless cylinder, followed by plating for fixing the resulting woven meshes the resulting sleeve is drawn out from the master roll, etc.

(3) The drawn-out sleeve as an image-supporter is inserted into the inside of a metal cylinder having a metal layer as an image-forming layer. This state is shown in FIG. 6 wherein h shows a metal cylinder and its inside i shows a releasing layer, e.g. chromium plated layer and m which is present insides thereof, shows a metal of the image-forming layer e.g. nickel obtained by a plating process. Then into the inside of a sleeve as an image-forming layer obtained by plating, a sleeve as an image-supporter, e.g. sleeve a obtained by plating is inserted. The contact part after insertion is shown in FIG. 7 in enlarged view. The whole body of the metal cylinder with an inserted sleeve is immersed in a chemical plating bath to apply chemical plating, or the whole body of the metal cylinder with an inserted sleeve is immersed in an electroplating bath, and electroplating is carried out after inserting an anode metal in the central part of the cylinder. As a result, the image-forming layer m and the sleeve layer a as an image-supporter are fixed together by the metal O deposited by plating as shown in FIG. 8. Further, as inferred from FIG. 9, it is also possible to effectively utilize the deposited metal O having fixed the image-forming layer m while coating the sleeve layer a as an image-supporter, and thereby to omit the m as an image-forming layer in FIG. 9.

As screens, those having good opening ratio are desired, because they provide greater area for passing ink at the time of printing. Among the sleeves obtained according to the method of the present invention, the sleeves having such a good openning ratio as never been obtained by a lacquer process or a galvano process can be obtained by making a sleeve as an image-supporter by way of electroplating process and fixing it onto an image-forming layer by way of electroplating. FIGS. 12*a*, 12*b* and 12*c* show the comparison. When a sleeve is produced according to a lacquer process and if plating is made only from one side in producing a sleeve having a predetermined strength, a minimum thickness of $y=80\mu$ is necessary in case of 100 lines/in. As a result, a transversal spread or expansion due to plating will also become $80\mu$, resulting in a hole dimension of $r=40\mu$ (FIG. 12*a*). In contrast, according to the method of the present invention, since plating is carried out on both the sides, the thickness of a sleeve will be sufficient if it enables to draw out the sleeve from a master roll, and a necessary minimum thickness becomes $z=40\mu$ (FIG. 12*b*). This is a case for a sleeve having a circumference of 640 mm and a length of 1500 mm. If the circumference and the length of sleeve are smaller, the thickness necessary for drawing out would be much thinner. Further, by using an electroplating process at the time of fixing onto an image-forming layer, it is possible to increase thickness alone and decrease deposit on the side of holes or on an image-forming layer, by the action of terminal current, resulting in a hole dimension of $r=80\mu$ (FIG. 12*c*). In terms of opening ratio, it is about 4 times improvement in case of square holes. This can be mentioned as one of the advantages attained according to the process of the present invention.

In FIGS. 12*a*, 12*b* and 12*c*, $x=200\mu$, $y=80\mu$, $z=40\mu$, $p=40\mu$, $q=120\mu$, $r=80\mu$ and $w=80\mu$.

(4) Then the metal of the image-forming layer and the sleeve as the image-supporter, fixed to a metal cylinder, are drawn out from the metal cylinder, the boundary at the time being the chromium layer inside the metal cylinder. As for a method for drawing out, e.g. a knife blade or the like is inserted between the image-forming layer and the chromium layer, and after partial releasing, releasing can be carried out easily by applying pressure with a rubber roll from the loosened or debonded part. This state is shown in FIG. 9.

(5) The resulting sleeve for rotary screen plating having a smooth surface of an endless metal image-forming layer, obtained through the above-mentioned steps, is freed of the unnecessary metal of image-forming layer by way of a presently used metal photomechanical process.

In this process, after a sleeve is expanded under a tension by fixing end rings to both the ends of the sleeve, it is set in a vertical ring coating machine to subject to defatting, water-washing, neutralization, and further water-washing. Then it is dried and coated with a solution of a light-sensitive resin. After drying, it is removed from the vertical ring coating machine, and the end rings are removed. Then a balloon-like rubber roll (bladder) is inserted into the sleeve and pressurized with compressed air so as not to create depressions. Then a film prepared in advance is contacted with the sleeve and set to a exposing machine to effect exposure. After exposure, the film is separated and subjected to development and water-washing to remove the light-sensitive resin in the unexposed parts and to expose the metal surface as the image-forming layer. This state is shown in FIG. 10. Then the image-forming layer alone where metal is exposed is removed by etching.

In carrying out etching, when a metal of an image-forming layer, a metal sleeve as an image-supporter and the metal used to fix both the metals are the same, or when such an etching solution as those having the same extent of corrosive property to all the metals, e.g. a ferric chloride solution is used, etching should be carried out while confirming that the image-forming layer is sufficiently etched but the screen layer as an image-supporter is not corroded during the process of etching. In this case a state shown in FIG. 10*a* is obtained, where a part of the screen metal as an image-supporter is corroded but this has no influence upon printing.

As for a method for completely protecting a metal screen part as an image-supporter at the time of etching, if nickel is used for the image-forming layer m as shown in FIG. 11*a*, and copper, chromium or a nickel alloy is used for the metal O for fixing the both, even when a metal screen a as an image-supporter is likewise of nickel, and further a mixed solution of nitric acid and hydrogen peroxide is used as an etching solution, then the copper or the like is scarcely corroded (cf. Japanese laid-open application No. 135703 of 1974).

As a result, etching stops in the state where the metal of the image-forming layer alone has been etched. By using a mixed solution of sulfuric acid and hydrogen peroxide, it is arranged that nickel is scarcely corroded and only the etching of copper proceeds, whereby exposed copper can be removed. In cases of chromium or a nickel alloy, the chromium or nickel alloy layer in the openning part is removed by using pressurized water. This state is shown in FIG. 11*b*.

Thus, by a combination of individual metals and selection of etching solution, it is possible to remove the metal alone fixed onto the metal of the image-forming layer through etching treatment, and thereby to produce sleeves without injuring the screen as an image-supporter at all. After etching is over, the compressed air is taken out to provide a sleeve for rotary screen printing.

If necessary, a cured membrane of a light-sensitive resin is removed by using a releasing solution (an organic solvent).

The sleeve containing an image, obtained through the above-mentioned steps is made entirely of metal. Since its surface supposed to be contacted with a to-be-printed object is smooth and in a seemless and endless roll form, there is no need of selection of pattern. Since images are made by way of an etching process, etching boundaries become sharp. Since there is no stretching or shrinkage such as swelling or the like due to a solvent of ink during printing time, sharp printing can be carried out. Since the material which fixes an image forming layer to a sleeve is metal, there is no attack of a solvent present in ink at all, and thus there is no falling of images nor change of printed matter which is liable to occur during printing time. Further such an anxiety as encountered during the time of washing and storage in case of resin e.g. deterioration of resin becomes unnecessary at all. Since sharp and endless sleeves for rotary screen printing, having superior durability to printing can be obtained, it should be said that the effectiveness attained according to the method of the present invention is extremely large.

The following examples are presented by way of illustration, but not for limiting the scope of claim.

EXAMPLE 1

On the surface of a copper roll having a circumference of 638.05 mm and a surface length of 400 mm, concave portions were engraved according to a carving process to give 80 lines/in. and the whole surface of the roll was plated in a plating bath of chromic acid to give a chromium thickness of 2μ all over the surface. Then a non-conductive resin (a thermosetting epoxy resin) was embedded in the concave portions and a master roll was obtained by carrying out grinding after drying. This master roll was plated in a nickel plating bath of nickel sulfamate to give a nickel thickness of 80μ. By inserting a knife blade into one end of the roll, the nickel layer was released from the master roll and after pressing was applied with a rubber roll to the whole surface of the master roll to loosen the adhesion or debond the whole surface, and then the nickel layer was drawn out of the master roll to provide a sleeve. Then the whole surface of an iron cylinder having an inside circumference of 640.19 mm, a length of 400 mm and a thickness of 5 mm was subjected to chromium plating to give a thickness of chromium of 2μ. The outer surface of this cylinder was coated with a non-conductive resin (a thermoset epoxy resin) and dried. A chromium-plated iron cylinder was inserted vertically into a nickel plating bath and a nickel rod was inserted in the middle of the cylinder and nickel plating was carried out so as to give a thickness of nickel of 30μ, while revolving the iron cylinder, to form an image-forming layer. Then the sleeve as an image-supporter made in advance was inserted into the cylinder and after repetition of water-washing, defatting, water-washing, neutralization and water-washing by way of a spraying process, nickel plating was carried out in the above-mentioned nickel bath so as to give a thickness of nickel of 2μ and to effect the fixing of both the nickel layers. After completion of plating, by inserting a knife blade into the inner end of the iron cylinder, the nickel sleeve as an image-forming layer was released from the chromium surface of the iron cylinder. From this part, pressing was applied with a rubber roll as in the above-mentioned case to debond the sleeve from the iron cylinder and draw out in the cylindrical form to give a printing sleeve. Then end rings were inserted in both the ends of the sleeve and set in a vertial ring coating machine, followed by repeating water-washing, defatting, water-washing, neutralization and drying. Thereafter the sleeve was coated with a solution of light-sensitive resin (polyvinyl cinnamate) and dried. After removing the end rings, a balloon-like rubber roll was inserted into the printing sleeve and expanded with compressed air. A film prepared in advance was tightly contacted with the membrane of the light-sensitive resin and exposed to light in a light-exposing machine. After completion of light exposure, the film was removed, developed and washed with water and the metal surface (nickel) as an image-forming layer of unexposed part was exposed to light. Then the sleeve was set in a spray type etching machine using an etching solution of 6.2% $HNO_3$ and 7% $H_2O_2$ and the nickel part of the exposed image-forming layer was etched while stopping the machine midways for checking. After completion of etching, washing was carried out with water and the exposed resin membrane drawn out from the balloon-like roll was released. When the resultant printing sleeve was examined sufficiently, the screen part as a supporter was found to be corroded more or less but did not give any obstacle for printing test and endless bright printing could be obtained.

EXAMPLE 2

Onto the inside of an iron cylinder having been chromium-plated in the same manner as in Example 1, nickel plating was carried out to give a thickness of nickel of 30μ, as an image-forming layer and then a nickel sleeve having a thickness of 80μ as an image-supporter was made in the same manner as in Example 1, and then drawn out from the copper cylinder. The adhesion of the nickel sleeve as an image-supporter to the nickel sleeve as an image-forming layer was carried out by inserting the nickel sleeve into the inner side of the iron cylinder, followed by washing, defatting, washing, neutralization and then immersing the resulting nickel sleeve together with the iron roll in a solution having a composition consisting of 40 g/l of nickel sulfate, 24 g/l of sodium citrate, 20 g/l of sodium hypophosphite, 14 g/l of sodium acetate and 5 g/l of ammonium chloride, as a chemically nickel-plating solution, at a solution temperature of 60° C. for one hour to give a thickness of 4μ. The nickel sleeve and the iron roll were taken out of the plating solution, and washed with water, the nickel sleeve was drawn out from the iron cylinder in the same manner as in Example 1, further an image was formed in the same manner as in Example 1 and etching was carried out. In this case, etching was carried out to the nickel as an image-forming layer, and in spite of the etching carried out for the same period of time as in Example 1, the chemically nickel-plated layer by which both of the image-forming layer and the image-supporter were adhered together was scarcely etched. This is believed to be due to the forming of an alloy plating of nickel and phosphorus in the chemically nickel-plated layer, taking into account the solution composition. Next, the cylinder was immersed in a 40° Be ferric chloride solution to etch the chemically nickel-plated layer. As a result, the nickel as an image-forming layer and the nickel as an image-supporter were also etched together with the nickel of the chemically nickel-plated layer to the same extent, by means of the ferric chloride solution, but no obstacle occurred at the time of printing, and an endless and clear printing could be carried out.

EXAMPLE 3

A nickel plating was carried out so as to give an image-forming layer having a thickness of 30μ in the same manner as in Example 1, and then a nickel sleeve as an image-supporter having the same thickness as in Example 1 in the same manner as in Example 1, was made, and after being drawn out, the sleeve, as an image-supporter, was inserted into the inner side of the image-forming layer. The sleeve and the iron cylinder were immersed in a chemical copper-plating bath having a composition consisting of 10 g/l of copper sulfate, 25 g/l of Rochelle salt, 10 g/l of paraformaldehyde and 0.1 g/l of thiorea and further containing sodium hydroxide having been added so as to give a pH of 12.5, at a solution temperature of 25° C., for 2 hours so as to give a thickness of 2μ, to carry out the adhesion between the image-forming layer and the image-supporting layer. Next, an image was formed in the same manner as in Example 1, and the exposed nickel as an image-forming layer was etched in the same etching manner as in Example 1. As a result, in spite of the same etching period of time as in Example 1, copper as an adhesion layer was not etched at all. Next, the cylinder was immersed in an etching aqueous solution containing 10% of sulfuric acid and 7% of hydrogen peroxide to etch the copper. Nickel was scarcely etched with this etching solution. As a result of inspection, no etching of the nickel as an image-supporter was observed, and an endless and clear printing could be carried out.

EXAMPLE 4

The inside of a chromium-plated iron cylinder having the same dimensions as in Example 1 was subjected to a chemical silver-plating to improve further releasability. A spent liquor obtained in the usual photo development was employed as a silver-plating solution. Next, copper-plating was carried out in a copper sulfate plating solution so as to give an image-forming layer having a thickness of 30μ. Thereafter a nickel sleeve was made in the same manner as in Example 1, drawn out from the master roll and inserted into the inside of the image-forming layer of the iron cylinder. The nickel sleeve together with the iron cylinder were immersed in a chemically copper-plating solution having the same composition as in Example 3 to adhere the image-forming layer and the image-supporter together. After an image was formed in the same manner as in Example 1, the sleeve and the layer having the image were set in a spray-etching machine containing a 40° Be ferric chloride etching solution, and etching was carried out. As a result, the exposed copper as an image-forming layer and the copper as an adhesion layer employed for adhering the image-supporter onto the image-forming layer were etched, but the nickel as an image-supporter was scarcely etched. As a result, a sleeve for rotary screen printing which was endless and clear and yet had a superior printing-durability was obtained.

EXAMPLE 5

A cylindrical sleeve having a mesh (300 lines/in.), woven with stainless steel filaments of 25μ in diameter in a square form, and having a circumference of 640 mm and a length of 400 mm (manufactured according to the method disclosed in Japanese patent laid-open No. 134405/1974) was inserted into the inside of an image-forming layer consisting of nickel made in advance in the same manner as in Example 1, and then the image forming layer and the cylindrical sleeve as an image supporter, made by weaving stainless steel filaments, were adhered together, in the same plating solution as in Example 1, and the sleeve was drawn out from the image forming layer. Next, an image was formed according to a photographic process in the same manner as in Example 1, and then etching was carried out employing an etching aqueous solution containing 6.2% of nitric acid and 7% of hydrogen peroxide. As a result, the exposed image-forming layer and the adhered layer (nickel) obtained by adhering the image-forming layer and the sleeve together could be etched without any etching of the stainless steel wire. At that time, when an image having a line width of 50μ was formed, a sufficient reproducibility was attained even by means of etching, and yet a clear printing of 50μ could be carried out.

EXAMPLE 6

The same treatment as in Example 5 was carried out except that nylon yarns were substituted for the stainless steel filaments of Example 5 and fixed by means of a chemical nickel-plating to obtain the same results.

EXAMPLE 7

A nickel sleeve having a thickness of 100μ was prepared by means of the master roll shown in Example 1, and inserted into the inside of a metal cylinder in the same manner as in Example 1, and then plating was carried out in the same manner as in Example 1 so as to give a plating thickness of 10μ, and the nickel sleeve containing the image forming layer was drawn out from the metal cylinder as in Example 1 to obtain an objective sleeve having an image-forming layer having a smooth surface.

What is claimed is:

1. A method for producing a rotary printing screen, comprising the steps of :
   - inserting a metal screen sleeve image supporter made by a plating process into the inside of a metal cylinder; and
   - immersing both said screen sleeve and said metal cylinder in a plating bath in order to coat said screen sleeve with a plated metal and simultaneously to form an image-forming layer.

2. A method for producing a rotary printing screen comprising the steps of:
   - inserting a metal screen sleeve image supporter made by a plating process into the inside of a non-metal cylinder, said non-metal cylinder having a conductive inside surface produced by a chemical plating process; and
   - immersing both said screen sleeve and said non-metal cylinder into a plating bath in order to coat said screen sleeve with a plated metal and simultaneously to form an image-forming layer.

3. A method for producing a rotary printing screen, comprising the steps of:
   - forming a metal image-forming layer on an inside surface of a metal cylinder, said layer being a smooth, endless outside surface of a cylindrical member having a thickness in the range of from 5 to 50 microns;
   - inserting within said metal cylinder a cylindrical screen sleeve image supporter, said sleeve being comprised of a metal; and
   - fixing said cylindrical member and said sleeve together by an electroplating process.

4. A method for producing a rotary printing screen, comprising the steps of:
   - forming a metal image-forming layer on an inside surface of a non-metal cylinder, said layer being a smooth, endless outside surface of a cylindrical member having a thickness in the range of from 5 to 50 microns;
   - inserting within said metal cylinder, a cylindrical screen sleeve image supporter, said sleeve being comprised of a non-metal having a surface provided with conductivity by means of a chemical plating process; and
   - fixing said cylindrical member and said sleeve together by an electroplating process.

5. A method for producing a rotary printing screen as in claim 3, wherein said metal image-forming layer having a smooth, endless outside surface is made by a plating process in the inside of a metal cylinder.

6. A method for producing a rotary printing screen as in claim 4, wherein said metal forming image layer having a smooth, endless outside surface is made by a plating process in the inside of a non-metal cylinder after said cylinder has been provided with conductivity by means of a chemical plating process.

7. A method for producing a rotary printing screen as in claim 3, further including the step of:

forming said screen sleeve image supporter by a plating process wherein nets of fine metal filaments are fixed together by said plating process.

8. A method for producing a rotary printing screen as in claim 7, wherein said fixing of said fine metal filaments is carried out by the steps of first utilizing a chemical plating process and then utilizing an electroplating process.

* * * * *